US010364596B2

(12) United States Patent
Kim

(10) Patent No.: US 10,364,596 B2
(45) Date of Patent: Jul. 30, 2019

(54) LEVER DEVICE FOR VEHICLE DOOR HANDLE

(71) Applicant: Hyundai Motor Company, Seoul (KR)

(72) Inventor: Jung Dae Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 1097 days.

(21) Appl. No.: 14/540,950

(22) Filed: Nov. 13, 2014

(65) Prior Publication Data

US 2016/0060913 A1 Mar. 3, 2016

(30) Foreign Application Priority Data

Sep. 3, 2014 (KR) ..... 10-2014-0117086

(51) Int. Cl.
*E05B 85/10* (2014.01)
*E05B 79/22* (2014.01)
*E05B 77/06* (2014.01)

(52) U.S. Cl.
CPC ..... *E05B 79/22* (2013.01); *E05B 77/06* (2013.01)

(58) Field of Classification Search
CPC ..... E05B 79/22; E05B 77/06
See application file for complete search history.

(56) References Cited

U.S. PATENT DOCUMENTS 7,111,880 B2 * 9/2006 Saitoh ..... E05B 77/04 292/336.3
8,727,402 B2 5/2014 Bejune et al.
9,611,675 B2 * 4/2017 Wittelsbuerger ..... E05B 77/02
2006/0049647 A1 3/2006 von zur Muehlen
2014/0138962 A1 5/2014 Nagata et al.

FOREIGN PATENT DOCUMENTS

| | | | |
|---|---|---|---|
| CN | 103573027 | A | 2/2014 |
| JP | 2005-036535 | A | 2/2005 |
| JP | 2008-184881 | A | 8/2008 |
| JP | 2013-14988 | A | 1/2013 |
| JP | 2013-238003 | A | 11/2013 |
| JP | 5420937 | B2 | 2/2014 |
| KR | 20-1999-0009754 | U | 3/1999 |
| KR | 10-2005-0077421 | A | 8/2005 |
| KR | 10-2010-0125132 | A | 11/2010 |
| KR | 10-2014-0040755 | A | 4/2014 |

* cited by examiner

*Primary Examiner* — Kristina R Fulton
*Assistant Examiner* — Thomas L Neubauer
(74) *Attorney, Agent, or Firm* — Morgan, Lewis & Bockius LLP

(57) ABSTRACT

A lever device for a vehicle door handle connecting a door handle to a cable operating a door latch device while being pulled by the door handle, may include a handle lever having a handle lever shaft rotatably mounted at a door; a handle connection part mounted at one side of the handle lever shaft and connected to the door handle; and a handle body part mounted at another other side of the handle lever shaft and provided with a coupling groove; and a link lever having a link lever shaft rotatably coupled between the handle lever and the door handle; and a link body part, one end which is selectively inserted into the coupling groove of the handle body part and another end thereof is connected to the cable.

6 Claims, 7 Drawing Sheets

LEVER DEVICE FOR VEHICLE DOOR HANDLE

CROSS-REFERENCE TO RELATED APPLICATION

The present application is based on and claims the benefit of priority to Korean Patent Application No. 10-2014-0117086, filed on Sep. 3, 2014 in the Korean Intellectual Property Office, the entire contents of which is incorporated herein for all purposes by this reference.

FIELD OF THE INVENTION

The present disclosure relates to a lever device for a vehicle door handle, and more particularly, to a lever device for a vehicle door handle capable of preventing a passenger from undesirably opening a door at the time of a lateral collision of the vehicle.

BACKGROUND OF THE INVENTION

Generally, a vehicle is provided with a door for user riding, in which the door is provided with a handle to open or close the door and the handle is classified into a type of lifting up the handle in a vertical direction and a bar type of allowing a user to pull the handle in a horizontal direction.

A vehicle door handle according to the related art may lead to an operation of a door latch due to inertia of parts of the door handle at the time of a lateral collision of the vehicle, and therefore the door is highly likely to be opened, such that passengers may be directly exposed to the outside and unfixed objects may be thrown out the vehicle.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a lever device for a vehicle door handle capable of preventing a passenger from undesirably opening a door at the time of a lateral collision of the vehicle, that is, achieving stability.

In an aspect of the present invention, a lever device for a vehicle door handle connecting a door handle to a cable operating a door latch device while being pulled by the door handle, may include a handle lever having a handle lever shaft rotatably mounted at a door, a handle connection part mounted at one side of the handle lever shaft and connected to the door handle, and a handle body part mounted at another other side of the handle lever shaft and provided with a coupling groove, and a link lever having a link lever shaft rotatably coupled between the handle lever and the door handle, and a link body part, one end which is selectively inserted into the coupling groove of the handle body part and another end thereof is connected to the cable.

The handle lever and the link lever are separated from each other while being separated from the coupling groove of the handle body part as the link body part rotates based on the link lever shaft by an impact force at a time of a lateral collision of the vehicle.

In the handle lever and the link lever, the handle body part rotates based on the handle lever shaft by the handle connection part at a time of an operation of the door handle and the cable is pulled while the link body part rotates based on the link lever shaft by the handle body part.

The link lever shaft is provided with a fitting groove in which the cable is fitted.

The handle lever shaft is provided with a return spring to elastically bias the handle connection part to a direction.

The link body part is formed in a cylindrical shape having a larger diameter than a diameter of the link lever shaft.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 5, FIG. 6 and FIG. 7 are diagrams illustrating an operation state of the lever device for a vehicle door handle of FIG. 1 according to the exemplary embodiment of the present disclosure, in which FIG. 5 is a diagram illustrating a coupled state between the handle lever and the link lever in a closed state of a door, FIG. 6 is a diagram illustrating a coupled state between the handle lever and the link lever in an opened state of a door, and FIG. 7 is a diagram illustrating a separated state of the handle lever from the link lever at the time of a lateral collision.

Figure 1:
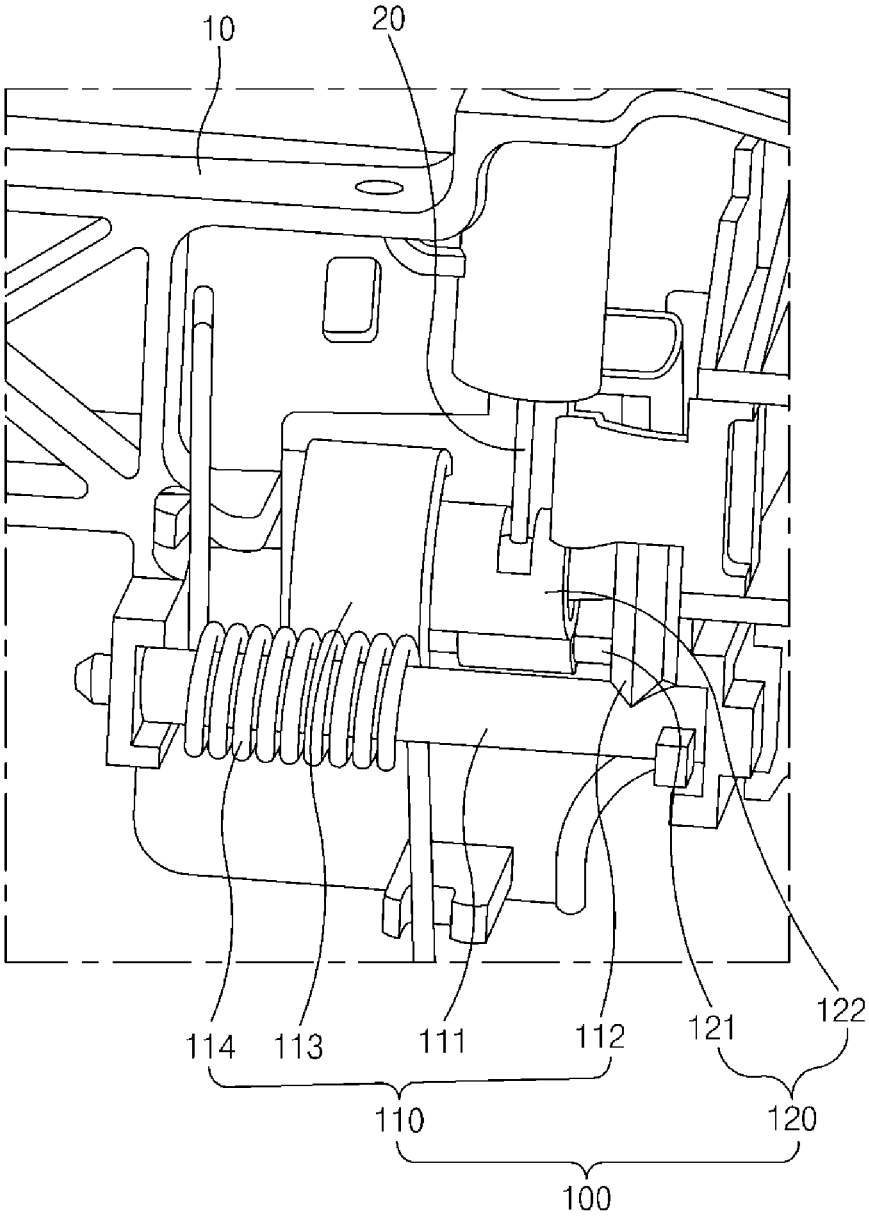
FIG. 1 is a perspective view illustrating a lever device for a vehicle door handle according to an exemplary embodiment of the present disclosure.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims Hereinafter, exemplary embodiments of the present disclosure will be described in detail with reference to the accompanying drawings so that they can be easily practiced by those skilled in the art to which the present disclosure pertains. However, the present disclosure may be modified in various different ways and is not limited to the exemplary embodiments provided in the present description. In the accompanying drawings, portions unrelated to the description will be omitted in order to obviously describe the present disclosure, and similar reference numerals will be used to describe similar portions throughout the present specification.

Referring to FIG. 1, a vehicle door according to an exemplary embodiment of the present disclosure includes a door handle 10 configured to be mounted on a door frame, a latch device configured to lock or unlock a door body by an operation of the door handle 10, and a cable 20 configured to be pulled by the door handle 10 to operate the latch device.

That is, the vehicle door according to the exemplary embodiment of the present disclosure operates the latch device while the cable 20 is pulled at the time of the operation of the door handle 10 so as to unlock the door body.

Meanwhile, the vehicle door according to the exemplary embodiment of the present disclosure has a problem in that the latch device may be unlocked while the door handle 10 and the cable 20 are pulled by an impact force or inertia at the time of the lateral collision of the vehicle and therefore a passenger may undesirably open a door. That is, the vehicle door has a problem of stability.

To solve the above problems, as illustrated in FIG. 1, the vehicle door according to the exemplary embodiment of the present disclosure includes a lever device 100 for a vehicle door handle which is disposed between the door handle 10 and the cable 20, in which the lever device 100 for a vehicle door handle may block a connection between the door handle 10 and the cable 20 at the time of the lateral collision of the vehicle to prevent the operation of the latch device and prevent the passenger from undesirably opening a door, that is, increase stability.

Figure 2:
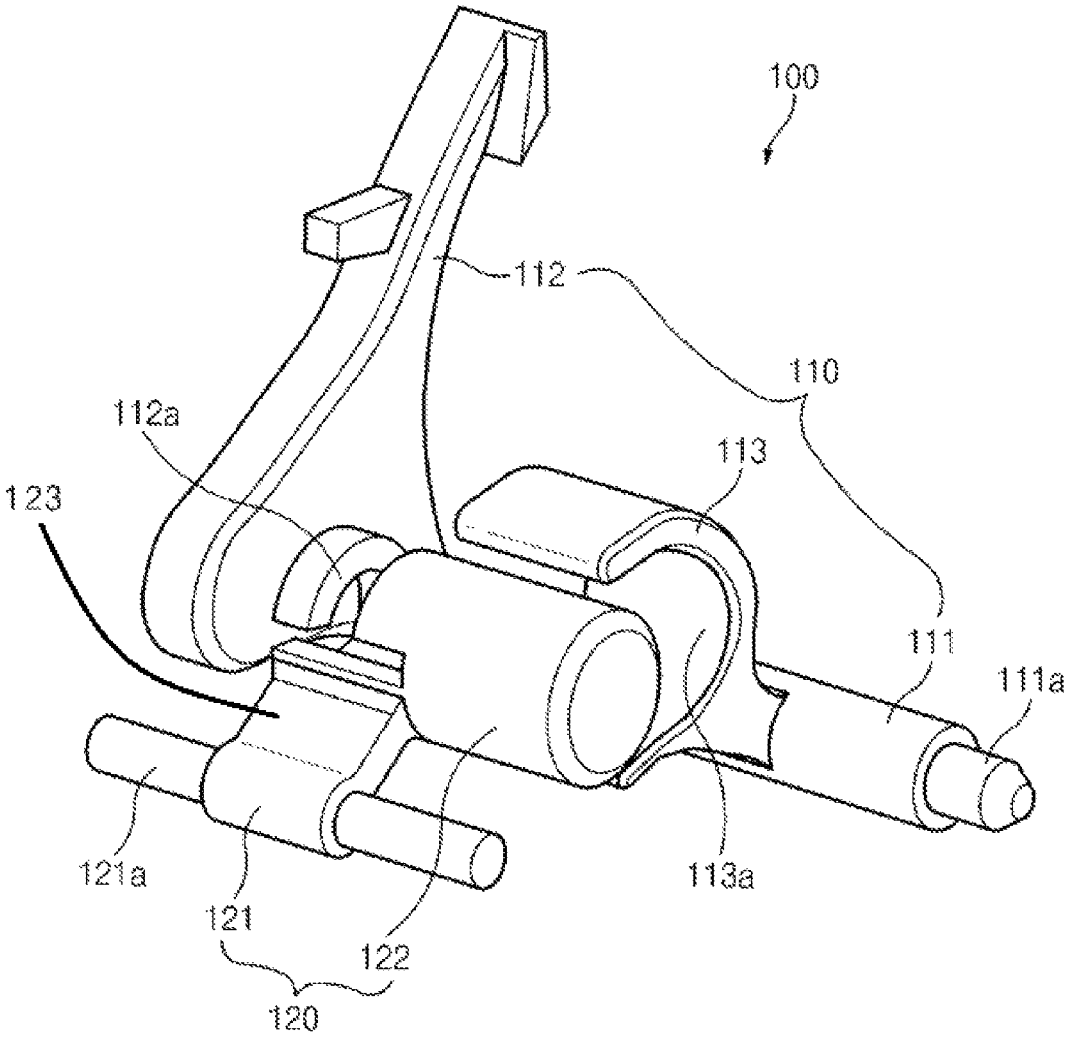
FIG. 2 is a perspective view illustrating a coupled state between a handle lever and link lever according to the exemplary embodiment of the present disclosure.
Figure 3:
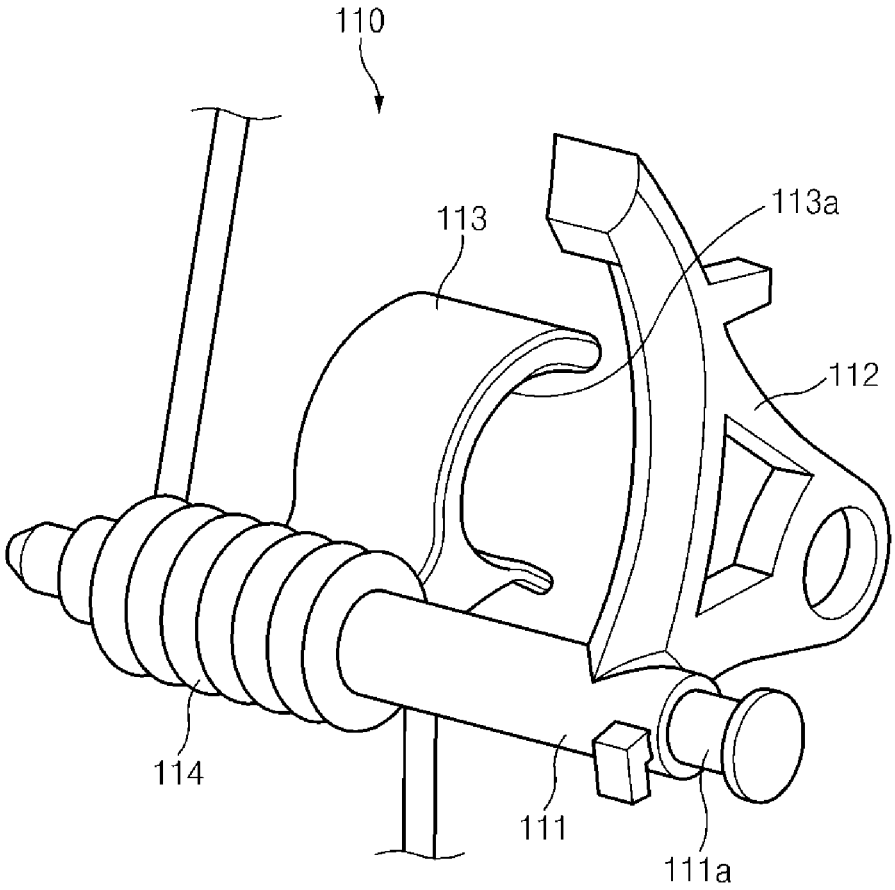
FIG. 3 is a diagram illustrating the handle lever according to the exemplary embodiment of the present disclosure.
Figure 4:
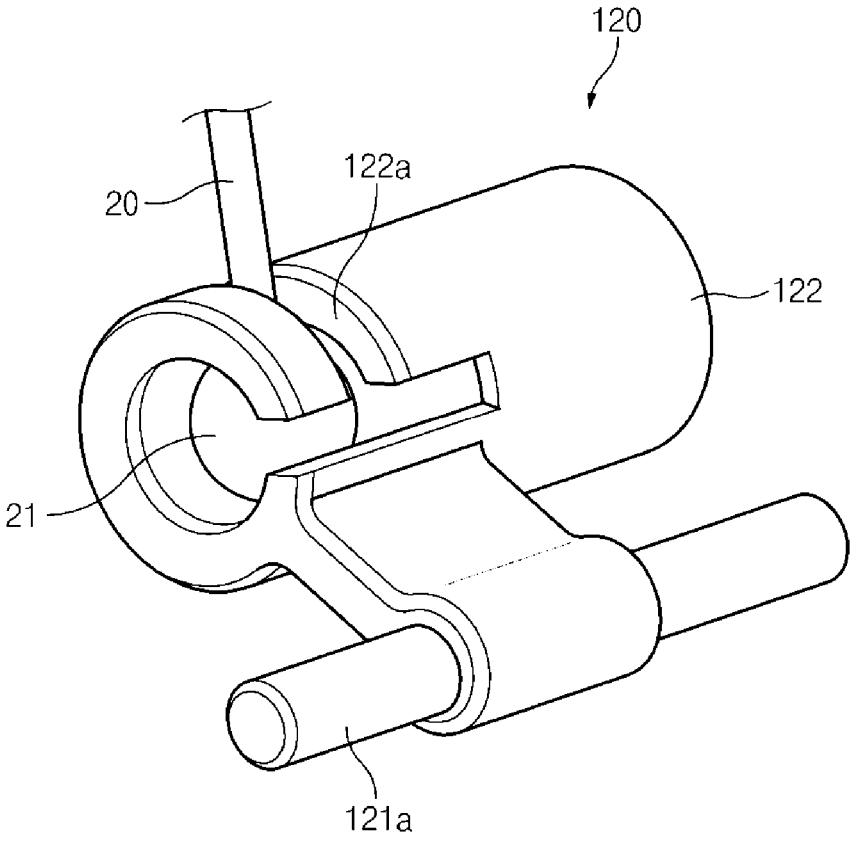
FIG. 4 is a diagram illustrating the link lever according to the exemplary embodiment of the present disclosure.

For example, as illustrated in FIGS. 2 to 4, the lever device 100 for a vehicle door handle according to the exemplary embodiment of the present disclosure includes a handle lever 110 configured to be connected to the door handle 10 and a link lever 120 configured to connect between the handle lever 110 and the cable 20 and block the connection while being separated from the handle lever 110 at the time of the lateral collision of the vehicle.

Referring to FIGS. 2 and 3, the handle lever 110 according to the exemplary embodiment of the present disclosure is provided with a handle lever shaft 111 configured to be rotatably mounted at a door side, a handle connection part 112 configured to be mounted at one side of the handle lever shaft 111 and connected to the door handle 10, and a handle body part 113 configured to be mounted at the other side of the handle lever shaft 111 and provided with a coupling groove 113*a* opened (when viewed from FIG. 1, opened toward the link lever) toward the outside.

The handle lever shaft 111 may be rotatably mounted at the door side due to a rotation pin 111*a* and may obtain durability and a smooth rotation force due to the rotation pin 111*a*.

The handle connection part 112 may be provided with a locking protrusion 112*a* which is locked to the door handle 10 and may stably connect the handle lever shaft 111 to the door handle 10 due to the locking protrusion 112*a*.

The handle body part 113 is provided with the coupling groove 113*a* of which the inner circumferential surface is an arc shape and may obtain a reduction in a friction force with the link body part and smooth operability due to the arc-shaped coupling groove 113*a*.

Figure 6:
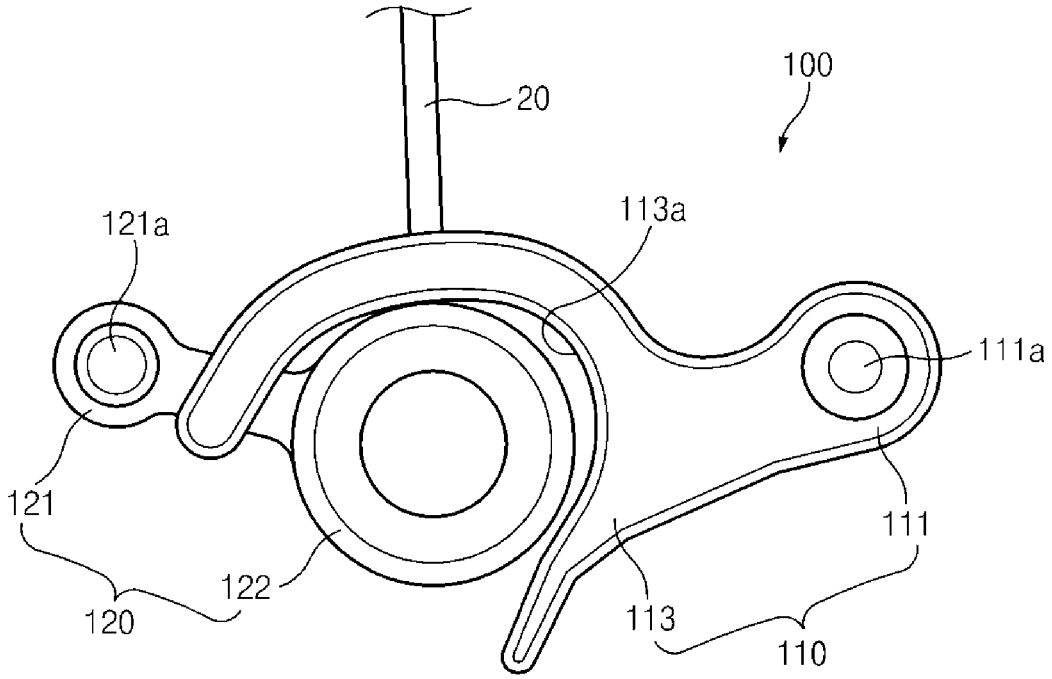

Referring to FIG. 6, when the door handle 10 is pulled, the handle lever 110 interlocks with the door handle 10 to pull the handle connection part 112. In this case, the handle connection part 112 is fixed to the handle lever shaft 111 and thus rotates based on the handle lever shaft 111 and the handle lever shaft 111 rotates and thus the handle body part 113 rotates.

Meanwhile, the handle lever 110 includes a return spring 114 which provides an elastic force to return to an original position when a force to pull the door handle 10 is removed.

That is, a center of the return spring 114 is coupled with the handle lever shaft 111, one end thereof is coupled with the handle connection part 112, and the other end thereof is coupled with the door side. That is, one end of the return spring 114 stores an elastic force while being folded in the other end direction at the time of the rotation of the handle connection part 112 and returns the handle connection part 112 to an original position due to the stored elastic force.

Referring to FIGS. 1 and 4, the link lever 120 according to the exemplary embodiment of the present disclosure is provided with a link lever shaft 121 configured to be rotatably coupled between the handle lever 110 and the door handle 10 and a link body part 122 whose one end is inserted into the coupling groove 113*a* of the handle body part 113 and the other end is connected to the cable 20.

The link lever shaft 121 connected to the link body part 122 by an extension part 123 may be rotatably mounted due to a rotation pin 121*a* and may obtain the durability and the smooth rotation force due to the rotation pin 121*a*.

The link body part 122 is inserted into the coupling groove 113*a* but has a cylindrical shape to minimize a friction force, and in particular, rotates based on the link lever shaft 121 at the time of the vehicle collision to have a larger diameter than that of the link lever shaft 121 so as to be separated from the coupling groove 113*a*. Further, a weight is also heavier than that of the link lever shaft 121.

When the handle lever 110 rotates downward, the link body part 122 coupled with the handle body part 113 moves downward. In this case, the link body part 122 is fixed to the link lever shaft 121 to rotate downward based on the link lever shaft 121 and the cable 20 is pulled by the rotation of the link body part 122.

In this configuration, as illustrated in FIG. 4, the link body part 122 is provided with a fitting part in which the cable 20 is fitted and the cable 20 may be coupled by the fitting part without a separate part. That is, the fitting part includes a spherical coupling ball 21 which is provided at a tip of the cable 20 and an insertion groove 122*a* which is provided at one side of the link body part 122 and is inserted with the coupling ball 21. In this configuration, the insertion groove 122*a* is formed in a "T"-letter shape so that the cable 20 connected to the coupling ball 21 is inserted thereinto while passing therethrough in zigzag, and thus the cable 20 keeps a stabilized coupling force as long as the worker does not separate the cable 20 from the insertion groove 122*a*.

According to the lever device 100 for a vehicle door handle, the cable 20 is pulled while the link lever 120 rotates by the rotation of the handle lever 110 at the time of the operation of the door handle 10 to unlock the latch device.

Here, the handle lever 110 is separated from the link lever 120 while the link lever 120 rotates due to the impact force or the inertia at the time of the lateral collision of the vehicle, that is, the link body part 122 is separated from the coupling groove 113*a* of the handle body part 113, such that even though the door handle 10 is operated, the cable 20 is not pulled to hold the locking of the latch device.

The operation state of the lever device for a vehicle door handle having the above configuration will be described in detail with reference to the accompanying drawings.

Figure 5:
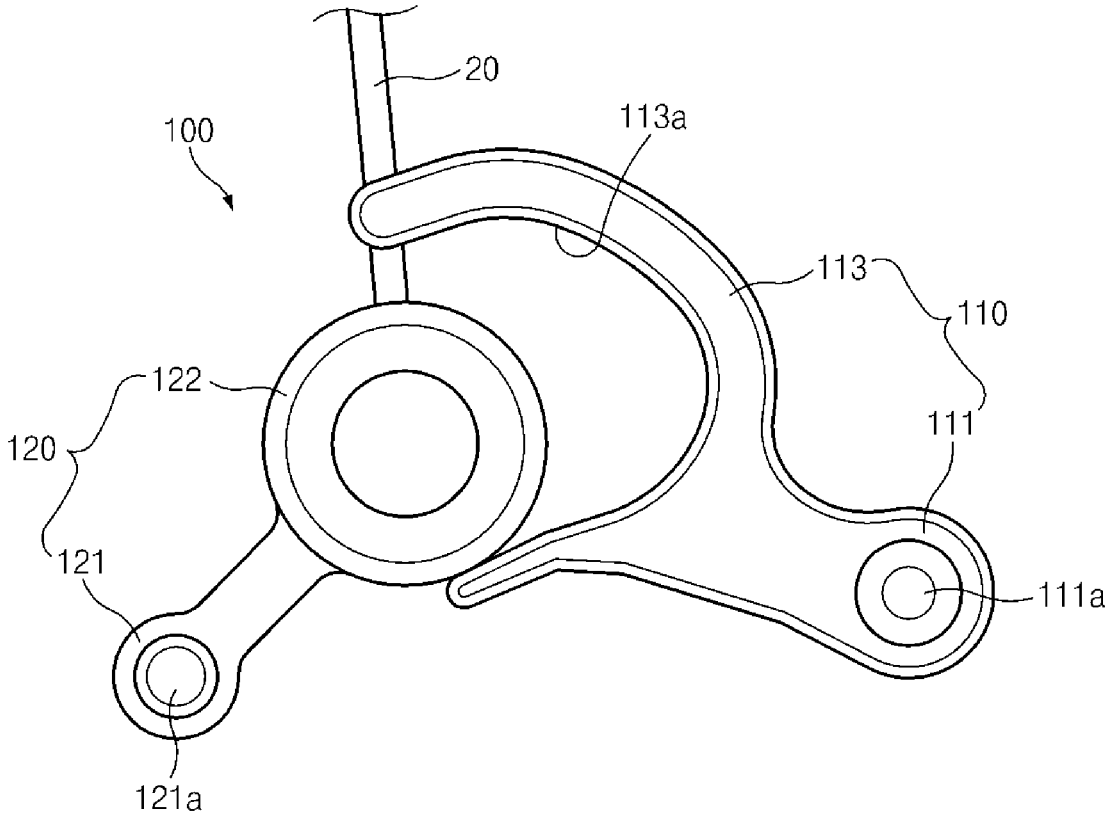

First, as illustrated in FIG. 5, when the door handle 10 is pulled, the latch device is unlocked while the cable 20 is pulled by the lever device 100 for a vehicle door handle and thus the door may be opened. That is, when the door handle 10 is pulled, the handle connection part 112 of the handle lever 110 interlocks therewith to rotate downward based on the handle lever shaft 111 and the handle body part 113 interlocks with the handle lever shaft 111 and thus the handle body part 113 rotates downward.

Further, as illustrated in FIG. 6, the link body part 122 of the link lever 120 rotates downward based on the link lever shaft 121 by the handle body part 113. In this case, the latch device is unlocked while the cable 20 connected to the link body part 122 is pulled.

Figure 7:
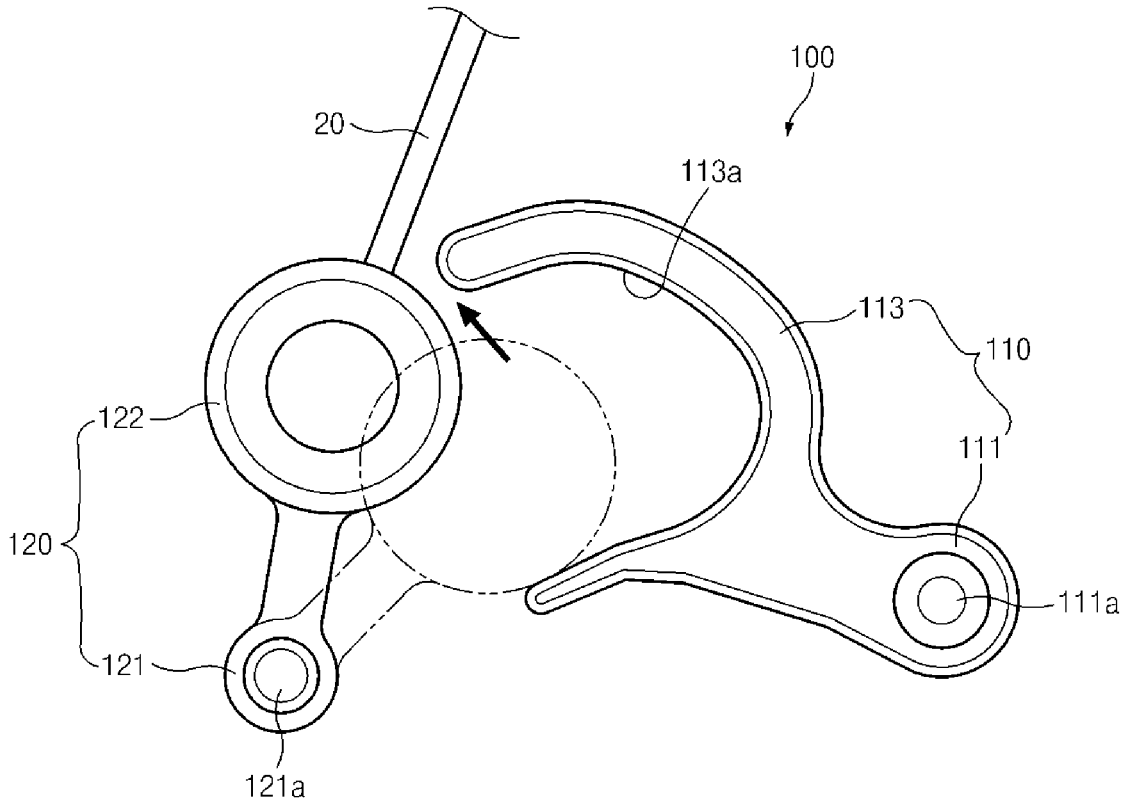

Meanwhile, as illustrated in FIG. 7, the operation connection between the link lever 120 and the handle lever 110 is blocked while the link lever 120 is separated from the handle lever 110 by the impact force or the inertia due to the lateral collision of the vehicle, such that the pulling of the cable 20 may be prevented and the unlocking of the latch device may be prevented. In other words, the opening of the door may be prevented. That is, the link body part 122 of the link lever 120 is separated from the coupling groove 113*a* of the handle body part 113 while rotating upward based on the link lever shaft 121 by the impact force while the door handle 10 is pulled at the time of the lateral collision of the vehicle, such that the handle lever 110 may be separated from the link lever 120.

As described above, according to the exemplary embodiments of the present disclosure, it is possible to prevent the passenger from undesirably opening the door by separating the handle lever from the link lever due to the impact force at the time of the lateral collision of the vehicle and thus increase the stability.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A lever device for a vehicle door handle connecting a door handle to a cable operating a door latch device while being pulled by the door handle, comprising:

a handle lever including:

a handle lever shaft rotatably mounted at a door;

a handle connection part mounted at a first side of the handle lever shaft and connected to the door handle; and a handle body part mounted at a second other side of the handle lever shaft and provided with a coupling groove; and a link lever including:

a link lever shaft rotatably coupled to a rotation pin and disposed between the handle lever and the door handle; and a link body part connected to the link lever shaft and selectively rotatable with respect to the rotation pin, wherein a first end of the link body part is selectively inserted into the coupling groove of the handle body part according to rotation of the link body part and a second end thereof is connected to the cable, wherein tire link body part has an extension part which extends from the link body part to the link lever shaft, and one end of the extension part is connected with the link lever shaft.

2. The lever device for the vehicle door handle according to claim 1, wherein the handle lever and the link lever are separated from each other while being separated from the coupling groove of the handle body part as the link body part rotates based on the link lever shaft by an impact force at a time of a lateral collision of the vehicle.

3. The lever device for the vehicle door handle according to claim 1, wherein in the handle lever and the link lever, the handle body part rotates based on the handle lever shaft by the handle connection part at a time of an operation of the door handle and the cable is pulled while the link body part rotates based on the link lever shaft by the handle body part.

4. The lever device for the vehicle door handle according to claim 1, wherein the link lever shaft is provided with a fitting groove in which the cable is fitted.

5. The lever device for the vehicle door handle according to claim 1, wherein the handle lever shaft is provided with a return spring to elastically bias the handle connection part to a direction.

6. The lever device for the vehicle door handle according to claim 1, wherein the link body part is formed in a cylindrical shape having a larger diameter than a diameter of the link lever shaft.

* * * * *